US005627000A

United States Patent [19]

Yamazaki et al.

[11] Patent Number: 5,627,000

[45] Date of Patent: May 6, 1997

[54] HEAT FIXING METHOD

[75] Inventors: Hiroshi Yamazaki; Tatsuya Nagase; Meizo Shirose; Yoshiki Nishimori, all of Tokyo, Japan

[73] Assignee: Konica Corporation, Japan

[21] Appl. No.: 536,449

[22] Filed: Sep. 29, 1995

[30] Foreign Application Priority Data

| | | | |
|---|---|---|---|
| Oct. 7, 1994 | [JP] | Japan | 6-244060 |
| Dec. 27, 1994 | [JP] | Japan | 6-324898 |
| Mar. 7, 1995 | [JP] | Japan | 7-047163 |

[51] Int. Cl.[6] ..... G03G 13/20

[52] U.S. Cl. ..... 430/99; 430/124

[58] Field of Search ..... 430/99, 124

[56] References Cited

U.S. PATENT DOCUMENTS

| | | | |
|---|---|---|---|
| 4,565,762 | 1/1986 | Kato | 430/99 |
| 5,135,883 | 8/1992 | Matsunaga et al. | 430/106.6 X |
| 5,157,445 | 10/1992 | Shoji et al. | 430/99 |
| 5,395,725 | 3/1995 | Bluett et al. | 430/124 |

*Primary Examiner*—Roland Martin

*Attorney, Agent, or Firm*—Jordan B. Bierman; Bierman and Muserlian

[57] ABSTRACT

A fixing method comprises the step of passing a recording material with a toner image between a heat fixing member and a pressure applying member to fix the toner onto the recording material, a silicone oil being coated on the surface of the heat fixing member, wherein the toner contains a binder resin and a low molecular weight polyolefin, and the silicone oil is a fluorine-containing silicone oil having a structure unit represented by the following Formula (I):

Formula (I)

wherein X represents a saturated hydrocarbon group having 1 to 4 carbon atoms or an aryl group; $R_f$ represents a fluoroalkyl group having 2–10 carbon atoms; and n represents an integer of 1 to 4.

16 Claims, 2 Drawing Sheets

HEAT FIXING METHOD

FIELD OF THE INVENTION

The invention relates to a heat fixing method for electrophotography, and to a contact-type heat fixing method which effectively prevents occurrence of offset phenomenon and which effectively prevents staining of a fixing roller.

BACKGROUND OF THE INVENTION

In electrophotography, a heat roller fixing method has been widely used to fix toner onto a recording material in view of its heat efficiency or suitability to high speed fixing. This heat roller fixing method is a method which passes a recording material having a toner image thereon between a heat roller with a heat source therein and a pressure applying roller, fusibly fixes the toner onto the recording material.

In this method, although the method has the above advantages, there is the so-called "offset phenomenon" disadvantage in which toner on a recording material is transferred to a heat roller, and after the rotation of the heat roller the toner is transferred to undesired portions of another recording material and fixed, resulting in staining on the recording material.

In order to prevent the offset phenomenon of the fixing roller, a technique supplying a dimethyl silicone oil onto the surface of the heat fixing roller has so far been proposed.

This method effectively prevents the offset phenomenon, however, it requires a silicone oil supplying device and has further a problem of smoking. On the other hand, there are many proposals which give anti-offset property to the toner itself, for example, a technique using a resin having a broad molecular weight distribution as a binder resin in the toner as disclosed in Japanese Patent O.P.I. Publication No. 50-234652/1975 and a technique adding a releasing agent such as a low molecular weight polypropylene as disclosed in Japanese Patent O.P.I. Publication No. 49-65231/1974.

The above proposed techniques definitely have an excellent effect on the prevention of the offset phenomenon, however, there is the problem in that they have only a narrow fixing temperature range and do not sufficiently show a fixing property, resulting in reduced life time of the fixing roller due to staining. The conventional silicone oil has a positive-charging property as a frictional electrification property, and the fixing roller having the silicone oil on the surface is likely to be positively charged. Therefore, when toner having a negative-charging property is used, a phenomenon is likely to occur in which a recording material is wound around the fixing roller, and when the conventional silicone oil is applied to the fixing roller, there is a limitation to toner used.

There has recently been proposed a technique in which a stationary heated member, in place of the heat fixing roller, contacts a pressure applying roller through a moving film material, and a recording material with a toner image is passed between the roller and the film to fusibly fix the toner, as disclosed in Japanese Patent O.P.I. Publication No. 5-119530/1993. This fixing method has an excellent heat efficiency, but has the same disadvantages as the above heat roller fixing method.

Japanese Patent O.P.I. Publication No. 52-124338/1977 discloses a fixing device employing a polysiloxane having a fluoroalkyl group, concretely, only a polysiloxane having a trifluoromethyl group at the end of the side chain, but there is no description regarding toner or offset phenomenon prevention. Japanese Patent O.P.I. Publication No. 3-95226/1991 discloses a polysiloxane having a trifluoromethyl group at the polymer end or at the side chain, which can be used in a roller for electrophotography, but there is no description regarding the concrete constitution of the electrophotography.

SUMMARY OF THE INVENTION

An object of the invention is to provide a heat fixing method which is free from occurrence of the offset phenomenon over a broad fixing temperature range, the winding phenomenon in which a recording material is wound around the fixing roller, and staining on a fixing member such as a fixing roller or a fixing film material for a long term.

Another object of the invention is to provide a heat fixing method in which adhesion of toner to fixing rollers is low and adhesion of toner to the recording material is high. Still another object of the invention is to provide a heat fixing method which improves developability and fixibility and can obtain an excellent image for a long term. Still further another object of the invention will be apparent below.

DETAILED DESCRIPTION OF THE INVENTION

Figure 1:
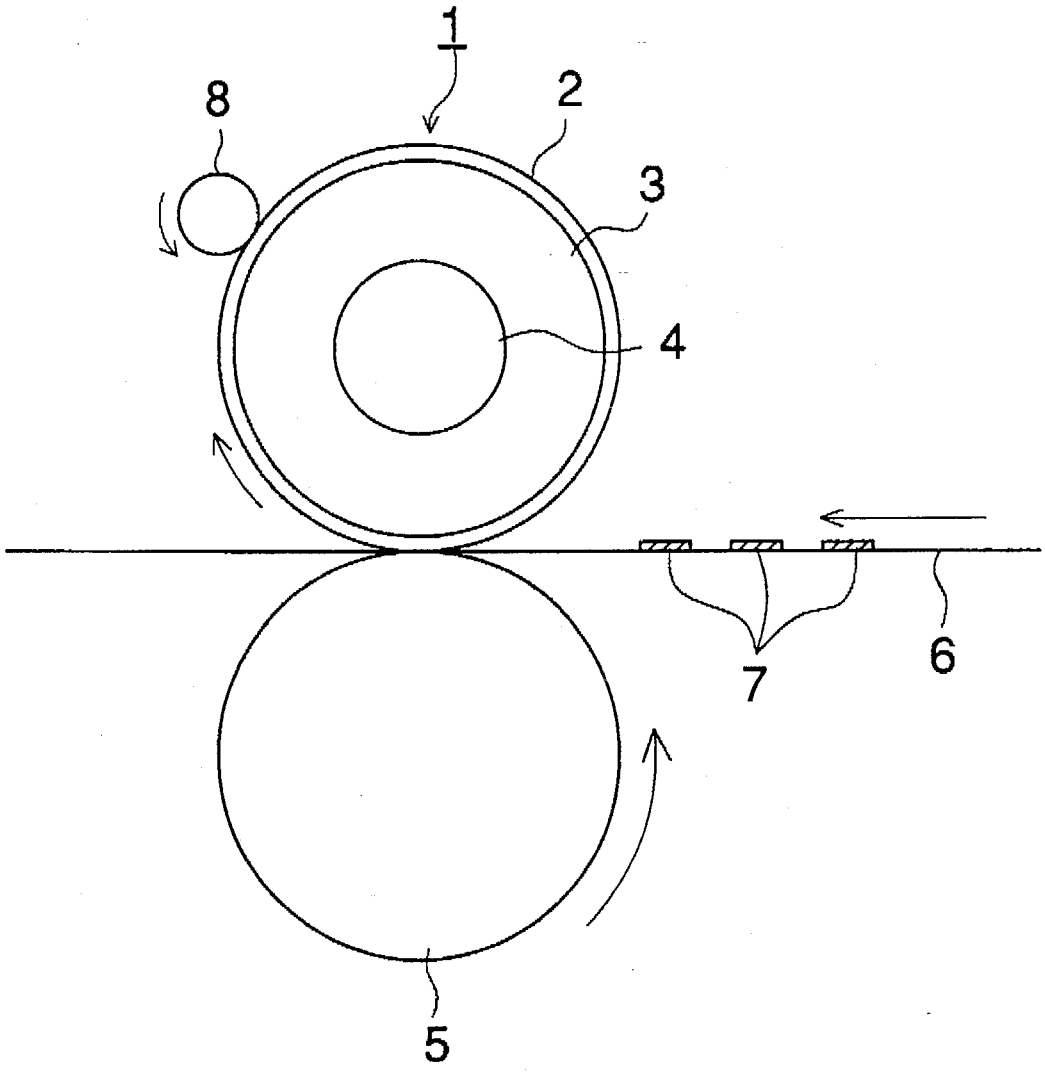
FIG. 1 shows an example of a heat roller fixing device in the invention.

The above object of the invention can be attained by the following:

(1) a fixing method comprising the step of passing a recording material with a toner image between a rotating fixing roller and a pressure applying roller contacting the fixing roller to fix the toner onto the recording material, a silicone oil being coated on the surface of the fixing roller, wherein the toner contains a low molecular weight polyolefin, and the silicone oil is a fluorine-containing silicone oil having a structure unit represented by the following Formula [I], or (2) a fixing method comprising the step of passing a recording material with a toner image between a moving film material and a rotating pressure applying member so that the toner image contacts the film material to fix the toner onto the recording material, the film material being positioned to contact the pressure applying member between a stationary heat source and the pressure applying member, silicone oil being coated on the surface of the film material on the pressure applying member side, wherein the toner contains a low molecular weight polyolefin, and the silicone oil is a fluorine-containing silicone oil having a structure unit represented by the following Formula [I],

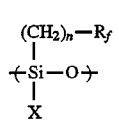

Formula [I]

wherein X represents a saturated hydrocarbon group having 1 to 4 carbon atoms or an aryl group; $R_f$ represents a fluoroalkyl group having 2 to 10 carbon atoms; and n represents an integer of 1 to 4.

The heat fixing method of the invention will be detailed below.

The fluorine-containing silicone oil of the invention is a silicone oil having a structure unit represented by the above formula (I).

In formula (I), X represents a saturated hydrocarbon group such as an alkyl group having 1 to 4 carbon atoms including a methyl, ethyl, propyl or butyl group or an aryl group such as a phenyl or naphthyl group; $R_f$ represents a fluoroalkyl group having 2 to 10 carbon atoms, and preferably 2 to 8 carbon atoms.

$R_f$ more preferably represents a group represented by $Z—(CF_2)_m—$ in which Z represent a hydrogen atom or a fluorine atom, and m represents an integer of 2 to 10, and preferably 2 to 8 as in the above fluoroalkyl group; and n represents an integer of 1 to 4.

It is essential that the fluorine-containing silicone oil of the invention have the above structure unit, but may be a copolymer further comprising a dimethyl silicone, phenylmethyl silicone or diphenyl silicone structure unit.

It is essential that the fluorine-containing silicone oil of the invention be a liquid having an appropriate viscosity on its usage and an oil having a molecular weight to some degree. Considering the degree of attaining the invention and the oil film-forming property on the fixing roller, the molecular weight has a viscosity of 20 to 1,000 centipoise (CS), and preferably 100 to 500 CS in terms of viscosity. The viscosity shows a kinetic viscosity, and is measured by means of a Ubbelohde's viscometer according to ASTM D445-46T or JIS Z8803. This viscosity can be controlled while adjusting the degree of polymerization in manufacturing the fluorine-containing silicone oil of the invention.

When the fluorine-containing silicone oil of the invention is a copolymer, the silicone oil preferably contains 20 mol % or more of the structure unit represented by Formula (I), in view of the degree of attaining the object of the invention. When the fluorine-containing silicone oil of the invention contains less than 20 mol % of the unit, the degree of attaining the invention deteriorates and property based on the other structure unit is likely to be effected, so that there sometimes occurs a problem that the object of the invention may not be attained.

The fluorine-containing silicone oil of the invention is synthesized in the same manner as the conventional silicone oil synthetic method. The dialkyl-substituted dichlorosilane is prepared from silicon and an alkyl chloride, and is hydrolyzed to form a siloxane. Thereafter, the cyclic oligomer or linear oligomer is formed and polymerized to obtain a silicone oil. The fluorine-containing silicone oil of the invention is one having a fluoroalkyl group in the side chain, and synthesized using a fluorine-containing compound having a chloro group at the end instead of an alkylchloride, for example, a compound having a structure represented by the following Formula [II]

$$Z(CF_2)_m(CH_2)_nCl \qquad \text{Formula [II]}$$

wherein Z, m and n represents the same as those denoted in Formula [I].

The typical examples of the compound represented by the following Formula [II] will be shown below.

(A) $CF_3CF_2CH_2Cl$
(B) $CF_3CF_2CF_2CH_2Cl$
(C) $CF_3CF_2CF_2(CH_2)_2Cl$
(D) $CF_3CF_2CF_2CF_2(CH_2)_2Cl$
(E) $CF_3CF_2CF_2CF_2CF_2CH_2Cl$
(F) $CF_3CF_2CF_2CF_2CF_2(CH_2)_3Cl$
(G) $CF_3CF_2CF_2CF_2CF_2CF_2CH_2Cl$
(H) $CF_3CF_2CF_2CF_2CF_2CF_2CF_2CH_2Cl$
(I) $HCF_2CF_2CH_2Cl$
(J) $HCF_2CF_2CF_2CH_2Cl$
(K) $HCF_2CF_2CF_2(CH_2)_2Cl$
(L) $HCF_2CF_2CF_2CF_2CH_2Cl$
(M) $HCF_2CF_2CF_2CF_2(CH_2)_2Cl$
(N) $HCF_2CF_2CF_2CF_2(CH_2)_4Cl$
(O) $HCF_2CF_2CF_2CF_2CF_2(CH_2)_3Cl$
(P) $HCF_2CF_2CF_2CF_2CF_2CF_2CH_2Cl$

The alkyl chloride for introducing an alkyl group other than a fluoroalkyl group to the oil includes methyl chloride, ethyl chloride, propyl chloride and butyl chloride.

In order to display an effect such as a uniform coating on a fixing roller covered with a fluorine-containing resin using the fluoroalkyl group substituted silicone oil in the invention, the number of the fluorine atoms is considered to play an important role. The fluorine-containing silicone oil of the invention is a silicone oil having a fluoroalkyl group of 2 to 10 carbon atoms, and preferably 2 to 8 carbon atoms, which is directly bonded through a methylene chain to a silicone atom of the silicone oil. The silicone oil having excessively many carbon atoms in the fluoroalkyl group has a problem in a fluidity property in applying heat. When a silicone oil containing no fluoroalkyl group is used, the wettability to a heat fixing roller covered with a fluorine-containing resin is not improved, and a uniform oil coating film is not formed.

The typical examples of the fluorine-containing silicone oil will be shown below.

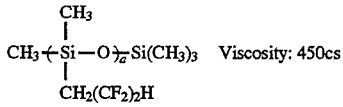
Viscosity: 450cs (1)

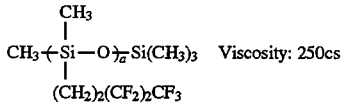
Viscosity: 250cs (2)

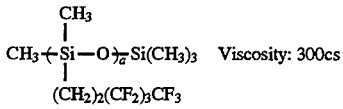
Viscosity: 300cs (3)

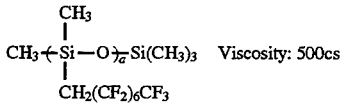
Viscosity: 500cs (4)

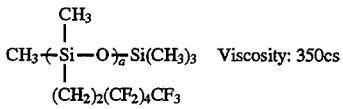
Viscosity: 350cs (5)

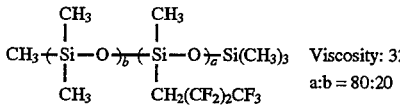
Viscosity: 320cs a:b = 80:20 (6)

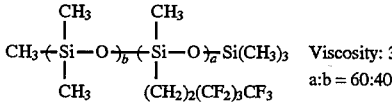
Viscosity: 300cs a:b = 60:40 (7)

-continued (8)

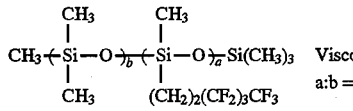

Viscosity: 300cs
a:b = 70:30

(9)

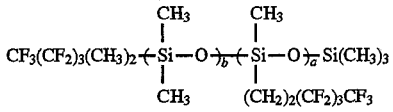

Viscosity: 300cs
a:b = 80:20

(10)

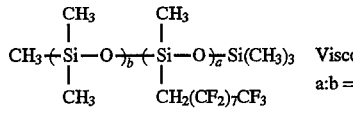

Viscosity: 450cs
a:b = 50:50

(11)

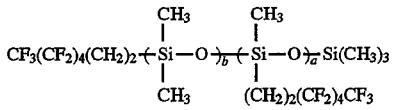

Viscosity: 200cs
a:b = 30:70

(12)

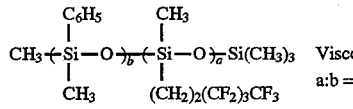

Viscosity: 500cs
a:b = 90:10

(13)

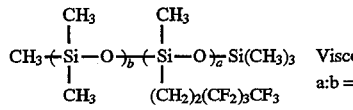

Viscosity: 300cs
a:b = 80:20

In the above Formula, a and b independently represent an integer of not less than 1, preferably 10 to 2000, and more preferably 100 to 1000.

The toner in the invention contains a low molecular weight polyolefin, and a combination use with the fluorine-containing silicone oil of the invention can provide a heat fixing method which can prevent occurrence of the offset phenomenon over such a broad fixing temperature range as has not been experienced in the conventional method, prolong a life of a fixing roller or fixing film material, and further prevent staining on the toner image.

The low molecular weight polyolefin used in the toner of the invention includes a low molecular weight polyethylene, polypropylene and polybutylene. The polyolefin includes a homopolymer or a copolymer with different olefins. The polyolefin of the invention is preferably a low molecular weight polyethylene, polypropylene or copolyethylenepropylene, and is more preferably a low molecular weight polypropylene.

The molecular weight of the low molecular weight polyolefin of the invention is within a range of a low molecular weight. The number average molecular weight ($M_n$) of the polyolefin is preferably 800 to 10,000, and more preferably 1,000 to 9,000. The weight average molecular weight ($M_w$) of the polyolefin is preferably 3,000 to 50,000, and more preferably 4,000 to 40,000. The molecular weight distribution of the polyolefin is preferably $M_w/M_n$ of 2 to 30.

The average molecular weight in the invention means that measured by high temperature GPC (Gel Permeation Chromatography). In the concrete method, o-dichlorobenzene containing 1% ionol is used as a solvent, a solution eluted at 135° C. is detected by means of a differential refractometer, and the average molecular weight (a number average molecular weight or a weight average molecular weight) is obtained according to the caribration method in terms of absolute molecular weight of polypropylene.

The synthetic method of the polyolefin in the invention is not specifically limited, but includes any conventional method, for example, a method of preparing the polyolefin by thermal decomposition of a high molecular polyolefin obtained according to the ordinary method. Adjustment of the molecular weight is carried out by fractionating to be within a preferable range of an average molecular weight or a molecular weight distribution by means of the above described GPC.

The polyolefin in the invention is used in any amount, but the polyolefin content of the toner is preferably 1 to 5% by weight based on the toner weight in that the invention is sufficiently effected.

In the toner of the invention the domain diameter of the low molecular weight polyolefin is preferably within the range of 0.1 to 1.0 μm. When the diameter is less than 0.1 μm, the decrease in adhesion of toner to the fixing member is not sufficient. To the contrary, when the diameter exceeds 1.0 μm, stable developing is obtained with difficulty, resulting in decrease in transferred toner amount, fog occurrence, and toner scattering.

As a means for controlling the domain diameter of the low molecular weight polyolefin, a releasing agent is used in the toner in addition to a binder. The releasing agent is used selecting kinds or amount thereof. A method is also used which controls, in a fusibly kneading process of toner, the kneading conditions such as the structure of a kneading screw, rotating speed thereof and the kneading temperature.

The domain diameter of the releasing agent is measured as follows:

The toner particles are buried in a resin and about 0.20 μm thick specimen is prepared by microtome. The specimen is photographed 1,200-magnified by means of a transmission electron microscope. From the thus obtained magnified photograph, the projected areas of the releasing agent are measured using an image analyzer SPICCA (produced by Nihon Avionics Co., Ltd.) and its number average of diameters of circles corresponding to the areas is computed.

The most preferable releasing agent used in the toner of the invention is a low molecular weight polyolefin having a number average molecular weight ($M_n$) of 800 to 10,000 and a weight average molecular weight ($M_w$) of 3,000 to 50,000, whose domain diameter is 0.1 to 1.0 μm.

The toner of the invention will be detailed below.

It is essential that the toner of the invention contains the above described low molecular weight polyolefin, and further contains other binder resin. The binder resin constituting the toner of the invention is not specifically limited, and the conventional various resins can be used. The resins include styrene type resins such as styrene resins, styrene-acrylate resins and styrene-butadiene resins and polyester type resins, which are preferably used.

The resin includes a polymer from styrene or styrene derivatives such as styrene, o-methylstyrene, m-methylstyrene, p-methylstyrene, α-methylstyrene, p-chlorestyrene, 3,4-dichlorostyrene, p-phenylstyrene, p-ethylstyrene, 2,4-dimethylstyrene, p-t-butylstyrene, p-n-hexylstyrene, p-n-octylstyrene, p-n-nonylstyrene, p-n-decylstyrene, and p-n-dodecylstyrene, methacrylates such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, and dimethylaminoethyl methacrylate, acrylates such as methyl acrylate, ethyl acrylate, n-butyl acrylate, isopropyl acrylate, isobutyl acrylate, t-butyl acrylate, n-octyl acrylate, 2-ethylhexyl acrylate, stearyl acrylate, lauryl acrylate, phenyl acrylate, diethylaminoethyl acrylate, and dimethylaminoethyl acrylate, vinyl esters such as vinyl propionate, vinyl acetate and vinyl benzoate, vinyl ethers such as vinyl methyl ether and vinyl ethyl ether, vinyl ketones such as vinyl methyl ketone, vinyl ethyl ketone and vinyl hexyl ketone, N-vinyl compounds such as N-vinyl carbazole, N-vinyl indole and N-vinyl pyrrolidone, vinyl compounds such as vinyl naphthalene and vinyl pyridine, and N-vinyl pyrrolidone, and acrylate or methacrylate derivatives such as acrylonitrile, methacrylonitrite, acrylamide, N-butylacrylamide, N,N-dibutylacrylamide, methacrylamide, N-butylmethacrylamide, and N-octadecylacrylamide. The resin in the invention preferably contains a unit from styrene in an amount of 60% or more. The reason is probably because the fluorine-containing silicone oil used in the invention is a material having a strong negative-charging property. Therefore, negative charge is accumulated due to the friction between fixing rollers or the friction between a film material and a pressure roller contacting the film material. As a result, in usage of toner having a positive charge rollers attracts the toner, and adhesion of the toner to the rollers, that is, offset phenomenon is likely to occur. The styrene resin is a material having a negative charging tendency. It is considered that the toner comprising a styrene resin containing not less than 60 weight % of a styrene unit has some negative charging property, static adhesion of the toner to fixing rollers decreases, and adhesion of the toner to paper increases.

The resin in the invention may be crosslinked by a crosslinking agent. The crosslinking agent includes divinyl benzene, ethyleneglycol diacrylate, diethyleneglycol diacrylate, triethyleneglycol diacrylate, ethyleneglycol dimethacrylate, diethyleneglycol dimethacrylate, and triethyleneglycol dimethacrylate. The amount used of the crosslinking agent is due to the desired crosslinking degree. The degree is adjusted in such a manner that the THF-insoluble component content of the resin is preferably not more than 10%. It is preferable in this case that the crosslinking agent is used in an amount of 0.01 to 5 weight %. When the amount of the crosslinking agent is excessive, the resin is hard but brittle, resulting in deteriorating of durability. When the amount is too small, the crosslinking agent is not effected. The measuring method of the THF-insoluble component content of the resin is as follows. To the THF is added 1% of a resin, and 30 sec supersonic wave being applied, insoluble components are sedimented by a centrifuge and supernatant is decanted. This process is repeated three times, and the resulting insoluble components are dried and weighed. Percentage (%) of the insoluble components are computed from the initial resin weight and the weight of the insoluble components.

The resin is preferably a resin containing a carboxylic acid group and so-called metal-crosslinked (ion-crosslinked) by a metal compound such as zinc oxide.

The resin can be synthesized according to an emulsion polymerization, a suspension polymerization or a solution polymerization.

The polymerization initiator includes peroxides such as benzoyl peroxide and lauryl peroxide or azo compounds such as azobisisobutyronitrile and azobisisovaleronitrile. The addition amount of the initiator is preferably 0.1 to 2 weight % based on the monomer weight. When the amount is far more than the range, the initiator decomposite has an adverse effect on the charging property, and there is further a problem in that the obtained resin has low molecular weight due to too high polymerization speed.

The polyester resin is obtained by polycondensation of a polycarboxylic acid having two or more carboxy groups with a polyhydric alcohol having two or more hydroxy groups. In the invention, the polyester resin having an aromatic group, which is prepared employing an aromatic polycarboxylic acid or an aromatic polyhydric alcohol, is preferable.

The aromatic polycarboxylic acid includes phthalic acid, isophthalic acid, telephthalic acid, 1,2,4-benzenetricarboxylic acid, 2,5,7-naphthalenetricarboxylic acid, 1,2,4-naphthalenetricarboxylic acid and pyromellitic acid and an anhydride thereof.

The dicarboxylic acid other than the above polycarboxylic acid includes maleic acid, fumalic acid, cytrconic acid, iraconic acid, succinic acid, adipic acid, sebatic acid, malonic acid, n-dodecylsuccinic acid, n-dodecenylsuccinic acid, isododecylsuccinic acid, isododecenylsuccinic acid, n-acid, n-octenylsuccinic acid, 1,2,4-butanetricarboxylic acid, 1,2,5-hexanetricarboxylic acid, 1,3-dicarboxyl-2-methyl-2-ethylenecarboxypropane, 1,2,4-cyclohexanetricarboxylic acid, tetra(methylenecarboxyl)methane, 1,2,7,8-octanetetracarboxylic acid, and and an anhydride thereof.

The aromatic polyhydric alcohol includes an etherified bisphenol A such as polyoxypropylene (2. 2)-2,2-bis(4-hydroxyphenyl) propane, polyoxypropylene (3.3)-2,2-bis(4-hydroxyphenyl)propane, polyoxyethylene (2. 0)-2,2-bis(4-hydroxyphenyl)propane, polyoxypropylene (2.0)-polyoxyethylene (2. 0)-2,2-bis(4-hydroxyphenyl)propane or polyoxypropylene (6)-2,2-bis(4-hydroxyphenyl)propane, bisphenol A, bisphenol Z and 1,3,5-trihydroxymethylbenzene.

The polyhydric alcohol other than the above polyhydric alcohol includes ethylene glycol, diethylene glycol, triethylene glycol, 1,2-propylene glycol, 1,3-propylene glycol, 1,4-butane diol, 1,4-butene diol, neopentyl glycol, 1,5-pentane glycol, 1,6-hexane glycol, 1,4-cyclohexane dimethanol, dipropylene glycol, polyethylene glycol, polypropylene glycol, polytetramethylene glycol, hydrogenated bisphenol A, sorbitol, 1,2,3,6-hexane tetrol, 1,4-sorbitan, pentaerythritol, dipentaerythritol, tripentaerythritol, 1,2,4-butane triol, 1,2,5-pentane triol, glycerol, 2-methylpropane triol, 2-methyl-1,2,4-butane triol, trimethylol ethane and trimethylol propane.

The content ratio of the above described acid to the alcohol is preferably 1:0.95–1.05 (in moles). The content of each of a tri- or higher polyhydric or a tri- or higher polycarboxylic component depends upon the cross-linking degree of the polyester. The optimal cross-linking degree is obtained by adjusting the content of each component. Generally, the content of the trivalent or higher component may be not more than 15 mol %.

The cross-linking degree being represented in terms of content of chloroform insoluble components, the polyester resin is one in which the content of chloroform insoluble components is 5 weight % or more, and preferably 10 to 50 weight %. The content of chloroform insoluble components is obtained according to the following method.

The resin sample of 5.00 g and 5.00 g of a filter auxiliary, radiolight (#700), are mixed, and 100 g of chloroform is added thereto. The resulting mixture is placed on a ball mill shelf and rotated for 5 hours or more to sufficiently dissolve the sample in the chloroform. On the other hand, a filter paper which is placed in a pressure filter, is uniformly pre-coated with 5.00 g of radiolight and is put into close contact with the filter with a slight amount of chloroform. Then, the above obtained solution is poured into the pressure filter. The walls of a vessel containing the solution are sufficientlly washed with chloroform to completely remove the residue. Thereafter, the filtering is carried out at a pressure of 4 kg/cm$^2$. After the chloroform solution is filtered out, the residue on the filter paper is washed with 100 g chloroform. After completion of the above processes, a mixture of the filter paper, the residue thereon and the radiolight are sufficiently dried. The total weight of the resulting mixture is measured and the weight content of the chloroform insoluble components is obtained according to the following equation.

Chloroform insoluble component content (weight %)=(dried mixture weight-filter paper weight-radiolight weight)×100/weight of the resin sample It is preferable that the polyester resin of the invention contain an aromatic ring in the main chain. Regarding the aromatic ring content, the content of the compound having an aromatic ring in the polyester is 10 weight % or more and preferably 30 to 90 weight %. When the aromatic ring content is excessive, the negative-charging property is excessive, resulting in an excessive static repulsion and occurrence of blurring. On the other hand, when the aromatic ring content is too small (less), negative-charging ability is less, resulting in lowering the effect which reduces adhesion of the toner to the fixing roller.

The styrene type resin in the toner of the invention has preferably a weight average molecular weight (Mw) of $1\times10^4$ to $1\times10^6$ and preferably a number average molecular weight (Mn) of $1\times10^3$ to $1\times10^5$ according to the GPC method. The weight average molecular weight (Mw) is more preferably $2\times10^4$ to $5\times10^5$ and the number average molecular weight (Mn) is more preferably $2\times10^3$ to $3\times10^4$. The ratio of the weight average molecular weight (Mw) to the number average molecular weight (Mn) is 4 to 80, and preferably 5–60.

The toner of the invention further contains an additive such as a coloring agent. The coloring agent is not specifically limited, and includes carbon black, nigrosine dyes, aniline blue, calco oil blue, chrome yellow, ultramarine blue, Dupont oil red, quinoline yellow, methylene blue chloride, phthalocyanine blue, malachite green oxalate and rose bengal, which are well known.

The other additives include, for example, a salicylic acid derivative, a charge controlling agent such as an azo metal complex and a fixibility improving agent such as carnauba wax. The inorganic fine particles include silica, titanium oxide, aluminium oxide and barium titanate, strontium titanate, each of which has a number average primary particle diameter of 5 to 1000 nm and may be made hydrophobic.

As a cleaning auxiliary agent, styrene-acryl resin fine particles having a number average primary particle diameter of 0.1 to 2.0 μm or a metal salt of a higher fatty acid such as zinc stearate may be used in toner.

The content of the inorganic fine particles may be 0.1 to 2.0% by weight based on the color particle toner. The cleaning auxiliary agent may be 0.01 to 1.0% by weight based on the color particle toner.

The toner of the invention may have any particle diameter, but usually has a volume average particle diameter of 1 to 30 μm, and preferably 5 to 15 μm.

When the toner of the invention constitutes a two-component developer, the carrier used may be any of a non-covered carrier consisting only of magnetic particles such iron or ferrite, a resin-covered carrier in which the surface of magnetic particles is covered with a resin and a resin-dispersed carrier in which a resin and magnetic powder are mixed. The carrier has a volume average particle diameter of preferably 30 to 150 μm.

When the toner of the invention constitutes a one-component developer, the developer preferably contains a ferromagnetic material such as magnetite which has a number average particle diameter of 0.1 to 2.0 μm, as a coloring agent. In this case the content of the ferromagnetic material is ordinarily 20 to 60% by weight based on the toner.

Further, in the invention, non-magnetic mono-component toner which consists only of non-magnetic toner without carrier may also be used.

The heat fixing method in the invention includes a heat roller fixing method and a method in which heating is carried out through a moving film material.

The fixing method used in the invention will be explained below.

The heat roller fixing method will be explained below using FIG. 1. The heat roller fixing device is composed of an upper roller 1 having a heat source 4 inside a cylinder made of a metal such as iron or aluminium, the surface 2 of which is covered with, for example, tetrafluoroethylene or tetrafluoroethylene-perfluoroalkylvinylether copolymer, and a lower heat roller 5 made of a silicone gum. The heat source 4 has a linear heater, which heats the surface of the upper roller 1 from about 110° to 220° C. The recording material 6 having a toner image 7 thereon is passed between the upper roller 1 and the lower roller 5 to fusibly fix the toner image 7 onto the recording material. Conventional toner causes the offset phenomenon in that some of the fused toner adheres to the upper roller 1 and the adhered toner, after one rotation of the roller, further adheres to undesired portions of the recording material. In extreme cases, there occurs the winding phenomenon that the recording material is caught by the toner having been adhered to the upper roller 1 and wound around the roller 1, accompanied by stainings on the fixing roller. In the heat roller fixing device, pressure is applied, deforming the lower roller and forming a nip between the upper and lower rollers. The fixing pressure in the invention is 0.1 to 2.0 kg/cm, and preferably 0.5 to 1.0 kg/cm in terms of line pressure or 5 to 30 kg, and preferably 10 to 25 kg in terms of total pressure. The nip width is 1 to 10 mm, and preferably 1.5 to 7 mm. The fixing line speed is preferably 40 to 4000 mm/second. When the nip width is less, it is difficult to apply a uniform heat to toner, resulting in fixing unevenness. When, on the other hand, the nip width is larger, toner fusing is promoted, and the offset phenomenon is more likely to occur.

In the heat roller fixing method of the invention, the fluorine-containing silicone oil film according to the invention is formed on the surface of upper roller 1. This film and the toner of the invention interact each other and the objects of the invention can be effectively attained.

One example of the method, in which the fluorine-containing silicone oil is supplied to upper roller 1 to form the silicone oil film, is as follows:

The fluorine-containing silicone oil impregnated pad roller 8 contacts the surface 2 of upper roller 1 and rotates in the arrow direction. The pad roller 8 is impregnated in advance with the fluorine-containing silicone oil of the invention to obtain the oil impregnated roller pad 8, and the fluorine-containing silicone oil of the oil impregnated roller 8 is supplied to the surface 2 of upper roller 1 little by little according to the rotation of the upper roller 1, whereby the fluorine-containing silicone oil film layer of the invention is formed on the surface 2 of the upper roller 1.

Next, the latter fixing methods in the invention will be explained below using FIG. 2.

The low heat content linear heater 15, which is attached to a fixing device, is composed of an aluminium base 17 having a thickness of 0.2 to 5.0 mm (preferably 0.5 to 3.5 mm), a width of 10 to 15 mm and a longitudinal length of 240 to 400 mm and coated thereon, a 1.0 to 2.5 mm thick resistant material, and is electrified from the both ends. The electrifying, which is controlled by a temperature sensor 16, is carried out in a pulse wave of 25 msec. period and DC 100 V and in a pulse width varied due to temperature and energy required. The surface temperature T2 of film material 14 directly under the resistant material is lower than temperature T1 detected by temperature sensor 16 in the low heat content linear heater. The temperature T1 is preferably 110° to 220° C., and temperature T2 is preferably 0.5° to 10° C. lower than temperature T1. The temperature T3 of the surface of the film material 14 at the point where the film material is separated from the toner fixing surface is substantially the same as temperature T2. The film material, which contacts the energy or temperature controlled heater, moves in the same direction as the recording material. The film material is a 10 to 35 μm thick heat resistant film such as polyester, polyperfluoroalkylvinyl ether, polyimide or polyetherimide which is covered with a 5 to 15 μm thick releasing layer containing a fluorine containing resin such as teflon and a conductive material, and is preferably an endless belt. The total thickness of the film material is generally 10 to 100 μm.

The film material 14 is transported without being crumpled and twisted by means of both transporting force of a transporting roller 11 and tension force of a freely moving roller 12. The fixing line speed is preferably 40 to 50 mm/second. The total pressure of 5 to 30 kg, preferably 10 to 25 kg or the line pressure of 0.1 to 2.0 kg/cm, preferably 0.5 to 1.0 kg/cm is applied by the pressure roller 13, which has an elastic layer of high separability made of, for example, a silicone gum, to contact the film material 14 with the low heat content linear heater 15. The pressure roller 13 rotates in the arrowed direction and passes the toner carrying recording material between the film material 14 and the pressure roller 13, whereby the toner contacts the low heat content linear heater 15 to be fusibly affixed onto the recording material.

Figure 2:
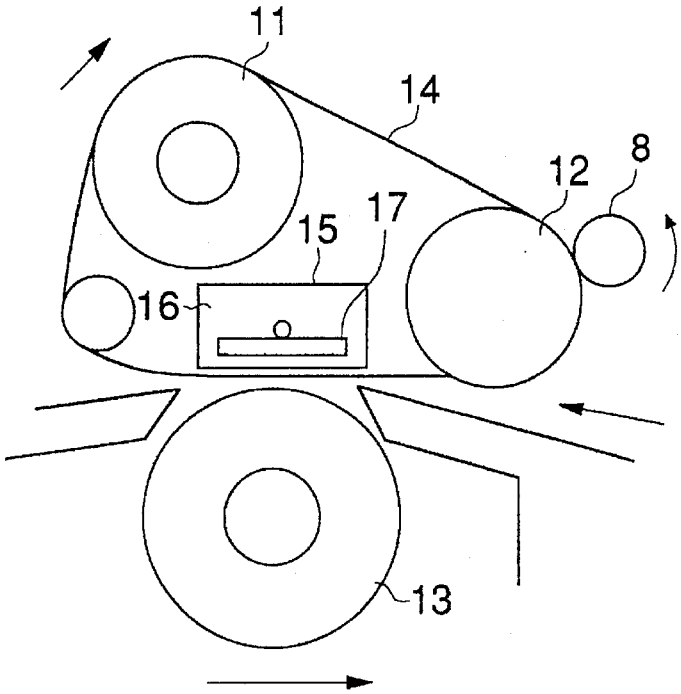
FIG. 2 shows an example of a heat fixing device in which a recording material contacts a heated member through a film material.

As described in FIG. 1, in FIG. 2 the oil impregnated pad roller 8 forcibly contacts the follower roller 12 through the film material 14 in the longituddinal direction of the film material and rotates in the arrow direction. In FIG. 2, the pad roller 8 is impregnated in advance with the fluorine-containing silicone oil of the invention to obtain the oil impregnated roller pad 8, and the pad roller 8 supplies the fluorine-containing silicone oil to the surface 2 of film material 14 little by little according to moving of film material 14, whereby the fluorine-containing silicone oil film layer of the invention is formed on the surface 2 on the pressure roller 13 side of film material 14.

Another example of the latter fixing method will be explained below using FIG. 3.

Figure 3:
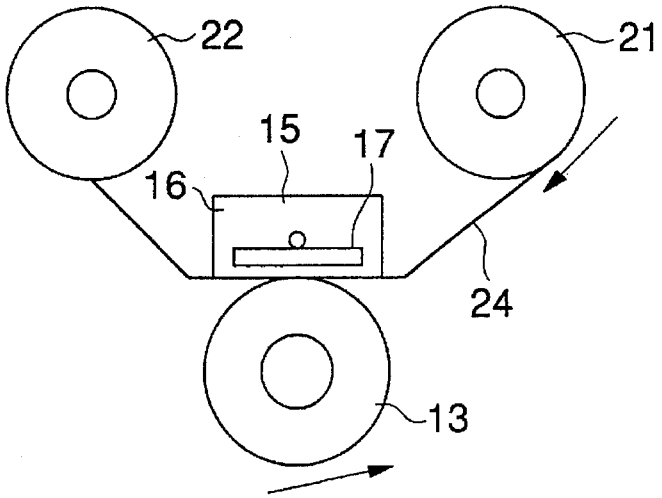
FIG. 3 shows an example of a heat fixing device in which the device shown in FIG. 2 is modified.

The example of FIG. 3 comprises a non-loop film material having two ends, in contrast to the FIG. 2 example comprising the endless film material. As shown in FIG. 2, the non-loop film material 24 is wound around a sheet feeding shaft 21 and a sheet winding shaft 22, and moves in crements in the arrowed direction. In this case, the winding shaft is powered. The numbers 13, 15, 16 and 17 are the same as those denoted in FIG. 2.

The non-loop film material 24, which has been wound around the sheet feeding shaft 21, is rolled around the winding shaft 22 little by little every fixing process whereby the toner carrying recording material passes between the film material 24 and the pressure roller 13, so that the toner contacts the low heat content linear heater 15 to be fusibly affixed onto the recording material.

The fluorine-containing silicone oil film forming method employing a silicone oil impregnated roller is disclosed in the illustrated Figures. Besides the above described, a pad or web impregnated with the fluorine-containing silicone oil may be used.

The maximum thickness of the oil film on the fixing roller or film material is preferably not more than $1.4\times10^{-6}$ cc/cm$^2$. The oil film thickness may be a thickness of mono molecular layer.

Typical examples of the invention will be shown below. The term "parts" refers to weight parts, unless otherwise specifically noted.

EXAMPLE 1

1. Preparation of low molecular weight polyolefin

Polypropylene (PP) prepared according to the conventional synthetic method was heat decomposed in a heat-fusible state to obtain polypropylenes PP-1 through PP-10 having an average number molecular weight as shown in the following Table. The resulting polypropylene was optionally fractionated through high temperature GPC.

The weight average molecular weight ($M_w$) and the number average molecular weight ($M_n$) were measured using SHODEX HT-806 by GPC-150C (produced by WATERS Co., Ltd.). As a solvent was used o-dichlorobenzene containing 1% ionol. The elution rate was 1 ml/minute, and the temperature was 135° C.

TABLE 1

| No. | $M_w$ | $M_n$ | $M_w/M_n$ |
|---|---|---|---|
| PP-1 | 3500 | 1200 | 2.9 |
| PP-2 | 7200 | 3100 | 2.3 |
| PP-3 | 12000 | 4300 | 2.8 |
| PP-4 | 15000 | 5300 | 2.8 |
| PP-5 | 28000 | 5100 | 5.5 |
| PP-6 | 33000 | 7400 | 4.5 |
| PP-7 | 39000 | 4400 | 9.8 |
| PP-8 | 39000 | 3400 | 11.5 |
| PP-9 | 38000 | 2900 | 13.1 |
| PP-10 | 39000 | 1600 | 24.4 |

2. Preparation of toner

One hundred parts of a polyester resin, 5 parts of carbon black and the above obtained polypropylene in an amount shown in Table 2 were mixed to obtain color particles having a volume average particle diameter of 8.3 μm. Thereafter, hydrophobic silica was added thereto in an amount of 0.8% to obtain toner of the invention. The thus obtained toner will be shown in the following Table.

TABLE 2

| Toner No. | PP used | Content of PP (parts) |
|---|---|---|
| Toner 1 | PP-1 | 2 |
| Toner 2 | PP-2 | 3 |
| Toner 3 | PP-3 | 3 |
| Toner 4 | PP-4 | 3 |
| Toner 5 | PP-5 | 3 |
| Toner 6 | PP-6 | 2 |
| Toner 7 | PP-7 | 3 |
| Toner 8 | PP-8 | 4 |
| Toner 9 | PP-9 | 3 |
| Toner 10 | PP-10 | 3 |
| Comparative Toner 1 | None | None |

Each of these toners was mixed with a ferrite carrier (having a volume average particle diameter of 62 μm) covered with a styrene-acryl resin to obtain developer having a toner content of 7 weight %.

* For a copier for evaluation, Konica 3035 produced by Konica Corporation was modified and used. The fixing device was substantially the same as one shown in FIG. 1. The fixing device was modified to obtain the following fixing conditions: As illustrated in FIG. 1 for heat roller, the heat roller fixing device has an upper roller 1, an iron cylinder of a 30 mm diameter, which is covered with tetrafluoroethyleneperfluoroalkylvinylether copolymer, with an internal heater, and a lower roller 5, a silicone gum of a 30 mm diameter, which is covered with tetrafluoroethyleneperfluoroalkylvinylether copolymer. The line pressure is 0.8 Kg/cm, and the nip width is 4.3 mm. The printing line speed of the fixing device is 250 mm/second. This fixing device was equipped with a cleaning device, which was a pad roller 8 impregnated with the fluorine-containing silicone oil of the invention. As the fluorine-containing silicone oil, Exemplified compound (3), (7), (8) and (9) were used, and the fixing rollers employing them were designated to be R-1, R-2, R-3 and R-4, respectively. The surface temperature of the fixing roller varies from 110° to 230° C.

The fixing condition of a film fixing device was as follows:

As is illustrated in FIG. 2, the film fixing device has an endless film sheet, and the fixing conditions are as follows:

Fixing Condition:

Heater 15 temperature T1=110° to 230° C.

Speed of the film material 14=250 mm/second

Total pressure between heater 15 and pressure applying roller 13=15 kg

Nip between pressure applying roller 13 and film material 14=3 mm

Film material 14: Fifteen μm thick polyimide film, which is covered with polytetrafluoroethylene on the surface of which a conducting material is dispersed.

This fixing device was equipped with a cleaning device, which was a pad impregnated with the fluorine-containing silicone oil in the same manner as FIG. 1. As the fluorine-containing silicone oil, Exemplified compound (3), (7), (8) and (9) were used, and the fixing film material employing themw were designated to be F-1, F-2, F-3 and F-4, respectively.

For comparison, a silicone oil composed of dimethyl polysiloxane (dimethyl silicone oil) or a fluorinated silicone oil (FS-1265 produced by Dow Corning Co., Ltd.) having a simple trifluoromethyl group as a side chain fluorinated alkyl as described in Japanese Patent O.P.I. Publication No. 52-124338/1977 was used in the above described impregnated roller 8. The heat roller fixing device using the dimethyl silicone oil was designated to be R-C1, the heat film material fixing device using the dimethyl silicone oil to be F-C1, the heat roller fixing device using the fluorinated silicone oil ($R_f$=—$CF_3$) outside the scope of the invention to be R-C2, and the heat film material fixing device using the fluorinated silicone oil ($R_f$=—$CF_3$) outside the scope of the invention to be F-C2.

Evaluation

Evaluation of Stains on the Fixing Roller

The pad roller was observed for staining after 200,000 sheets of paper were copied at 10° C. and 10% RH (relative humidity), using the above developer from an original having a 20% text image density. The results are shown in Tables 3 and 4. In this evaluation, in order to forcibly produce stains 1000 sheets of paper were copied intermittently, and then electricity source was switched off for 2 hours. Thereafter, the copying in this manner was repeated.

After the 200,000 copies, copying was further continued in which the copying was suspended for 10 hours after every twenty thousand sheets. The image on the sheet copied immediately after the 10 hour suspension was evaluated, and the first copy, on which stains occurred by transferring from the pad roller, was counted. The evaluations were carried out at a fixing temperature of 170° C. The results are shown in Tables 5 and 6.

TABLE 3

| | Heat Roller Fixing device (Staining of Pad Roller) | | | | | |
|---|---|---|---|---|---|---|
| Toner No. | R-1 | R-2 | R-3 | R-4 | R-C1 | R-C2 |
| Toner 1 | Slightly | Slightly | Slightly | Slightly | Markedly | Markedly |
| Toner 2 | Slightly | Slightly | Slightly | Slightly | Markedly | Markedly |
| Toner 3 | Slightly | Slightly | Slightly | Slightly | Markedly | Markedly |
| Toner 4 | Slightly | Slightly | Slightly | Slightly | Markedly | Markedly |
| Toner 5 | Slightly | Slightly | Slightly | Slightly | Markedly | Markedly |
| Toner 6 | Slightly | Slightly | Slightly | Slightly | Markedly | Markedly |
| Toner 7 | Slightly | Slightly | Slightly | Slightly | Markedly | Markedly |
| Toner 8 | Slightly | Slightly | Slightly | Slightly | Markedly | Markedly |
| Toner 9 | Slightly | Slightly | Slightly | Slightly | Markedly | Markedly |
| Toner 10 | Slightly | Slightly | Slightly | Slightly | Markedly | Markedly |
| Comparative Toner 1 | Markedly | Markedly | Markedly | Markedly | Markedly | Markedly |

TABLE 4

| Toner No. | Film Material Fixing device (Staining of Pad Roller) | | | | | |
|---|---|---|---|---|---|---|
| | F-1 | F-2 | F-3 | F-4 | F-C1 | F-C2 |
| Toner 1 | Slightly | Slightly | Slightly | Slightly | Markedly | Markedly |
| Toner 2 | Slightly | Slightly | Slightly | Slightly | Markedly | Markedly |
| Toner 3 | Slightly | Slightly | Slightly | Slightly | Markedly | Markedly |
| Toner 4 | Slightly | Slightly | Slightly | Slightly | Markedly | Markedly |
| Toner 5 | Slightly | Slightly | Slightly | Slightly | Markedly | Markedly |
| Toner 6 | Slightly | Slightly | Slightly | Slightly | Markedly | Markedly |
| Toner 7 | Slightly | Slightly | Slightly | Slightly | Markedly | Markedly |
| Toner 8 | Slightly | Slightly | Slightly | Slightly | Markedly | Markedly |
| Toner 9 | Slightly | Slightly | Slightly | Slightly | Markedly | Markedly |
| Toner 10 | Slightly | Slightly | Slightly | Slightly | Markedly | Markedly |
| Comparative Toner 1 | Markedly | Markedly | Markedly | Markedly | Markedly | Markedly |

TABLE 5

| Toner No. | Heat Roller Fixing device (Numbers in which Stains Occurred) | | | | | |
|---|---|---|---|---|---|---|
| | R-1 | R-2 | R-3 | R-4 | R-C1 | R-C2 |
| Toner 1 | None | None | None | None | 100,000 | 120,000 |
| Toner 2 | None | None | None | None | 80,000 | 140,000 |
| Toner 3 | None | None | None | None | 80,000 | 160,000 |
| Toner 4 | None | None | None | None | 100,000 | 120,000 |
| Toner 5 | None | None | None | None | 100,000 | 120,000 |
| Toner 6 | None | None | None | None | 80,000 | 100,000 |
| Toner 7 | None | None | None | None | 80,000 | 100,000 |
| Toner 8 | None | None | None | None | 80,000 | 100,000 |
| Toner 9 | None | None | None | None | 80,000 | 100,000 |
| Toner 10 | None | None | None | None | 80,000 | 100,000 |
| Comparative Toner 1 | 40,000 | 40,000 | 40,000 | 40,000 | 20,000 | 40,000 |

TABLE 6

| Toner No. | Film Material Fixing device (Numbers in which Stains Occurred) | | | | | |
|---|---|---|---|---|---|---|
| | F-1 | F-2 | F-3 | F-4 | F-C1 | F-C2 |
| Toner 1 | None | None | None | None | 100,000 | 140,000 |
| Toner 2 | None | None | None | None | 80,000 | 120,000 |
| Toner 3 | None | None | None | None | 80,000 | 120,000 |
| Toner 4 | None | None | None | None | 100,000 | 140,000 |
| Toner 5 | None | None | None | None | 80,000 | 120,000 |
| Toner 6 | None | None | None | None | 80,000 | 100,000 |
| Toner 7 | None | None | None | None | 80,000 | 100,000 |
| Toner 8 | None | None | None | None | 80,000 | 100,000 |
| Toner 9 | None | None | None | None | 80,000 | 120,000 |
| Toner 10 | None | None | None | None | 80,000 | 120,000 |
| Comparative Toner 1 | 40,000 | 60,000 | 60,000 | 60,000 | 40,000 | 40,000 |

As is apparent from the above, the present invention can provide a heat fixing method which is free from occurrence of the offset phenomenon over a broad fixing temperature range, and staining on the surface of the fixing member.

EXAMPLE 2

Preparation of low molecular weight polyolefin

Polypropylenes PP-1 through PP-10 were obtained in the same manner as in Example 1.

Synthetic example of Resin

Synthetic example 1 of Resin

A resin was prepared from 96 weight parts of styrene, 4 weight parts of 2-ethylhexylacrylate and 0.5 weight parts of benzoyl peroxide according to a solution polymerization. The resulting resin was designated as Resin 1, which contained 0% of THF-insoluble components.

Synthetic example 2 of Resin

A resin was prepared from 86 weight parts of styrene, 14 weight parts of n-butylmethacrylate and 0.5 weight parts of benzoyl peroxide according to a solution polymerization. The resulting resin was designated as Resin 2, which contained 0% of THF-insoluble components.

Synthetic example 3 of Resin

A resin was prepared from 76 weight parts of styrene, 24 weight parts of n-butylacrylate, 0.1 weight parts of divinylbenzene and 0.5 weight parts of benzoyl peroxide according to a solution polymerization. The resulting resin was designated as Resin 3, which contained 5.2% of THF-insoluble components.

Synthetic example 4 of Resin

A resin was prepared from 70 weight parts of styrene, 16 weight parts of n-butylmethacrylate, 14 weight parts of 2-ethylhexylacrylate and 0.5 weight parts of benzoyl peroxide according to a solution polymerization. The resulting resin was designated as Resin 4, which contained 0% of THF-insoluble components.

Synthetic example 5 of Resin

A resin was prepared from 65 weight parts of styrene, 21 weight parts of methylmethacrylate, 14 weight parts of n-butylmethacrylate and 0.5 weight parts of benzoyl peroxide according to a solution polymerization. The resulting resin was designated as Resin 5, which contained 0% of THF-insoluble components.

Synthetic example 6 of Resin

A resin was prepared from 76 weight parts of styrene, 22 weight parts of n-butylacrylate, 2 weight parts of methacrylic acid, 0.5 weight parts of zinc oxide and 0.5 weight parts of benzoyl peroxide according to a solution polymerization. The resulting resin was designated as Resin 6, which contained 1.2% of THF-insoluble components.

Synthetic example 1 of Comparative Resin

A resin was prepared from 55 weight parts of styrene, 24 weight parts of methylmethacrylate, 21 weight parts of n-butylmethacrylate and 0.5 weight parts of benzoyl peroxide according to a solution polymerization. The resulting resin was designated as Comparative Resin 1.

One hundred parts of the above obtained resin, 6 parts of carbon black and the amount shown in Table 7 of the polypropylene of the invention were mixed, and fusibly kneaded, pulverized and classified to obtain color particles having a volume average particle diameter of 8.5 μm. Thereafter, hydrophobic silica was added thereto in an amount of 0.7% to obtain toners 101 through 111 of the invention and comparative toners 101 and 102. Using the thus obtained toner, the molecular weight of the resin was measured. The results are shown in Table 7. The molecular weight was measured in terms of polystyrene by means of GPC.

TABLE 7

| Toner No. | Resin | PP used | Content of PP | $M_w$ | $M_n$ | $M_w/M_n$ |
|---|---|---|---|---|---|---|
| Toner 101 | Resin 1 | PP-1 | 3 | $14 \times 10^4$ | $5 \times 10^3$ | 28 |
| Toner 102 | Resin 2 | PP-2 | 2 | $17 \times 10^4$ | $3 \times 10^3$ | 57 |
| Toner 103 | Resin 3 | PP-3 | 3 | $12 \times 10^4$ | $4 \times 10^3$ | 30 |
| Toner 104 | Resin 4 | PP-4 | 3 | $9 \times 10^4$ | $4 \times 10^3$ | 23 |
| Toner 105 | Resin 5 | PP-5 | 4 | $8 \times 10^4$ | $13 \times 10^3$ | 6 |
| Toner 106 | Resin 6 | PP-6 | 2 | $20 \times 10^4$ | $5 \times 10^3$ | 40 |
| Toner 107 | Resin 1 | PP-7 | 3 | $14 \times 10^4$ | $5 \times 10^3$ | 28 |
| Toner 108 | Resin 3 | PP-8 | 3 | $12 \times 10^4$ | $4 \times 10^3$ | 30 |
| Toner 109 | Resin 4 | PP-9 | 3 | $9 \times 10^4$ | $4 \times 10^3$ | 23 |
| Toner 110 | Resin 5 | PP-10 | 3 | $8 \times 10^4$ | $13 \times 10^3$ | 6 |
| Toner 111 | Resin 1 | PP-2 | 3 | $14 \times 10^4$ | $5 \times 10^3$ | 28 |
| Comparative Toner 101 | Comparative Resin 1 | PP-1 | 3 | $14 \times 10^4$ | $5 \times 10^3$ | 28 |
| Comparative Toner 102 | Resin 1 | None | 3 | $14 \times 10^4$ | $5 \times 10^3$ | 28 |

Each of these toners was mixed with a ferrite carrier having a volume average particle diameter of 62 μm covered with a styrene-acryl resin to obtain developer having a toner content of 7 weight %.

For a copier for evaluation, Konica 3035 produced by Konica Corporation was modified and used. The fixing conditions were the same as Example 1. The evaluation was carried out as follows:

Evaluation

Evaluation of Fixing Ratio

The fixing ratio was measured as follows:

The solid image was developed using the above obtained developers, and then transferred to paper. The transferred image was fixed at 10° C. and 10% RH (relative humidity) using the above fixing device, the fixing temperature being raised from 110° C. to 230° C. at 5° C. increments. After the resulting paper was folded at the transferred image portions, the image was rubbed ten times with a cloth using a friction fastness tester and the image reflection densities before and after the rubbing were measured with RD-918. The fixing ratio was measured from the density difference according to the following equation. The initial image density was adjusted to 1.40 relative to 0 of the background density of paper and the measurement was carried out.

Fixing ratio=Density after Rubbing/Density before Rubbing (1.40)×100(%)

When the fixing ratio is 70% or more, there is no problem for practical use. The evaluation was carried out at the temperature at which the fixing ratio of 70% was obtained.

The results are shown in Tables 8 and 9.

TABLE 8

| | (Heat Roller Fixing) | | | | | |
|---|---|---|---|---|---|---|
| Toner No. | R-1 | R-2 | R-3 | R-4 | R-C1 | R-C2 |
| Toner 101 | 145 | 145 | 145 | 145 | 165 | 160 |
| Toner 102 | 145 | 145 | 145 | 145 | 160 | 155 |
| Toner 103 | 150 | 150 | 150 | 150 | 165 | 160 |

TABLE 8-continued

| | (Heat Roller Fixing) | | | | | |
|---|---|---|---|---|---|---|
| Toner No. | R-1 | R-2 | R-3 | R-4 | R-C1 | R-C2 |
| Toner 104 | 145 | 145 | 145 | 145 | 160 | 155 |
| Toner 105 | 150 | 150 | 150 | 150 | 165 | 160 |
| Toner 106 | 150 | 155 | 155 | 155 | 170 | 165 |
| Toner 107 | 145 | 145 | 145 | 145 | 165 | 160 |
| Toner 108 | 150 | 150 | 150 | 150 | 170 | 165 |
| Toner 109 | 150 | 150 | 150 | 150 | 170 | 165 |
| Toner 110 | 145 | 145 | 145 | 145 | 170 | 165 |
| Toner 111 | 145 | 145 | 145 | 145 | 165 | 165 |
| Comparative Toner 101 | 160 | 160 | 160 | 160 | 180 | 175 |
| Comparative Toner 102 | 175 | 175 | 175 | 175 | 185 | 180 |

TABLE 9

| | (Film Fixing) | | | | | |
|---|---|---|---|---|---|---|
| Toner No. | F-1 | F-2 | F-3 | F-4 | F-C1 | F-C2 |
| Toner 101 | 140 | 140 | 140 | 140 | 160 | 155 |
| Toner 102 | 140 | 140 | 140 | 140 | 155 | 150 |
| Toner 103 | 145 | 145 | 145 | 145 | 160 | 155 |
| Toner 104 | 140 | 140 | 140 | 140 | 155 | 150 |
| Toner 105 | 145 | 145 | 145 | 145 | 160 | 155 |
| Toner 106 | 145 | 145 | 145 | 145 | 170 | 160 |
| Toner 107 | 140 | 140 | 140 | 140 | 160 | 155 |
| Toner 108 | 145 | 145 | 145 | 145 | 165 | 160 |
| Toner 109 | 145 | 145 | 145 | 145 | 165 | 160 |
| Toner 110 | 140 | 140 | 140 | 140 | 165 | 160 |
| Toner 111 | 140 | 140 | 140 | 140 | 160 | 160 |
| Comparative Toner 101 | 155 | 155 | 155 | 155 | 175 | 170 |
| Comparative Toner 102 | 170 | 170 | 170 | 170 | 180 | 175 |

The toner of the invention containing polystyrenes and low molecular polyolefins statically repulses the fixing rollers at a low temperature and humidity. As a result, adhesion of the toner to the rollers decreases and the adhesion to paper increases.

EXAMPLE 3

Synthetic example of a resin

In a reaction vessel equipped with a thermometer, a stirrer, a nitrogen introducing tube and a condenser were placed a polyvalent carboxylic acid in amounts shown in Table 5 and a polyhydric alcohol as shown in Table 10. The resulting mixture was heated under a nitrogen atmosphere, added with a slight amount of dibutyltin oxide and the reaction was carried out at 200° C. The reaction was initially carried out between bifunctional compounds, and tri- or more-functional compounds were added at the time dibutyltin oxide was added. The reaction was stopped at the time predetermined chloroform-insoluble components or compounds having a predetermined molecular weight were obtained. In the following Table 10, the amounts of the compounds are given in terms of weight ratio.

TABLE 10

| | Aromatic Polycarboxylic Acid | | | Aliphatic | Aromatic | Aliphatic Polyhydric Alcohol | | |
|---|---|---|---|---|---|---|---|---|
| | Trifunctional | Bifunctional | | carboxylic Acid | Dihydric Alcohol | Trifunctional | Bifunctional | |
| Resin No. | TMA | TPA | IPA | DKA | BPA | PG | NPG | TMP |
| Resin 11 | 6 | 74 | 5 | 15 | 27 | 66 | 7 | |
| Resin 12 | 6 | 74 | | 20 | 15 | 70 | 15 | |
| Resin 13 | 5 | 50 | 10 | 35 | 10 | 65 | 25 | |
| Resin 14 | 6 | 74 | | 20 | | 65 | 30 | 5 |
| Resin 15 | 4 | 54 | 2 | 40 | | 75 | 25 | |
| Resin 16 | | 80 | | 20 | 5 | 75 | 20 | |
| Comparative Resin 11 | | | | 100 | | 75 | 25 | |
| Comparative Resin 12 | | | | 100 | | 70 | 20 | 10 |

*TMS: 1,2,4-Benzenetricarboxylic acid
*TPA: Telephthalic acid
*IPA: Isophthalic acid
*DKA: n-Dodecenylsuccinic acid
*BPA: Polyoxypropylene(2,2)-2,2-bis(4-hydroxyphenyl)propane
*PG: Propylene glycol
*NPG: Neopentyl glycol
*TMP: Trimethylol propane The chloroform-insoluble components and the content of the aromatic compounds in the above described resins were shown in the following Table 11.

TABLE 11

| Resin No. | Aromatic Compound Content | Chloroform-insoluble component Content |
|---|---|---|
| Resin 11 | 59.6% | 34% |
| Resin 12 | 47.5% | 27% |
| Resin 13 | 37.5% | 17% |
| Resin 14 | 40.0% | 40% |
| Resin 15 | 30.0% | 12% |
| Resin 16 | 42.5% | 0% |
| Comparative Resin 11 | 0% | 0% |
| Comparative Resin 12 | 0% | 17% |

One hundred parts of each of the above obtained resins, 6 parts of carbon black and the low molecular weight polyolefin shown in Table 1 of Example 1 in an amount shown in Table 12 were mixed, fusibly-kneaded, pulverized and classified to obtain color particles having a volume average particle diameter of 8.5 μm. Thereafter, hydrophobic silica was added thereto in an amount of 0.7% by weight to obtain toners 121 through 130 and comparative toners 121 through 123. The molecular weight of the resins was measured using the above toner, and the results are shown in Table 12.

The molecular weight measured by GPC is one represented in terms of molecular weight of polystyrene.

TABLE 12

| Toner No. | Resin | PP used | Content of PP | $M_w$ | $M_n$ | $M_w/M_n$ |
|---|---|---|---|---|---|---|
| Toner 121 | Resin 11 | PP1 | 3 | $6 \times 10^4$ | $3 \times 10^3$ | 20 |
| Toner 122 | Resin 12 | PP2 | 3 | $5 \times 10^4$ | $3 \times 10^3$ | 17 |
| Toner 123 | Resin 13 | PP3 | 3 | $5 \times 10^4$ | $4 \times 10^3$ | 12 |
| Toner 124 | Resin 14 | PP4 | 3 | $7 \times 10^4$ | $3 \times 10^3$ | 23 |
| Toner 125 | Resin 15 | PP5 | 3 | $4 \times 10^4$ | $4 \times 10^3$ | 10 |
| Toner 126 | Resin 16 | PP6 | 3 | $5 \times 10^4$ | $4 \times 10^3$ | 13 |
| Toner 127 | Resin 11 | PP7 | 3 | $6 \times 10^4$ | $3 \times 10^3$ | 20 |
| Toner 128 | Resin 12 | PP8 | 3 | $5 \times 10^4$ | $3 \times 10^3$ | 17 |
| Toner 129 | Resin 13 | PP9 | 3 | $5 \times 10^4$ | $4 \times 10^3$ | 12 |
| Toner 130 | Resin 14 | PP10 | 4 | $7 \times 10^4$ | $3 \times 10^3$ | 23 |
| Comparative Toner 121 | Comparative Resin 11 | PP1 | 3 | $4 \times 10^4$ | $5 \times 10^3$ | 8 |
| Comparative Toner 122 | Comparative Resin 12 | PP1 | 3 | $6 \times 10^4$ | $5 \times 10^3$ | 12 |
| Comparative Toner 123 | Comparative Resin 12 | None | 3 | $6 \times 10^4$ | $5 \times 10^3$ | 12 |

Each of these toners was mixed with a ferrite carrier (having a volume average particle diameter of 62 μm) covered with a styrene-acryl resin to obtain developer having a toner content of 7 weight %. The same procedures as Example 2 were carried out, using the above obtained developer. The results are shown in Tables 13 and 14.

TABLE 13

| (Heat Roller Fixing) Toner No. | R-1 | R-2 | R-3 | R-4 | R-C1 | R-C2 |
|---|---|---|---|---|---|---|
| Toner 121 | 140 | 140 | 140 | 140 | 160 | 155 |
| Toner 122 | 140 | 140 | 140 | 140 | 155 | 155 |
| Toner 123 | 145 | 145 | 145 | 145 | 165 | 160 |
| Toner 124 | 140 | 140 | 140 | 140 | 160 | 155 |
| Toner 125 | 145 | 145 | 145 | 145 | 160 | 160 |
| Toner 126 | 145 | 145 | 145 | 145 | 165 | 160 |
| Toner 127 | 140 | 140 | 140 | 140 | 160 | 155 |
| Toner 128 | 145 | 145 | 145 | 145 | 165 | 160 |
| Toner 129 | 145 | 145 | 145 | 145 | 165 | 160 |
| Toner 130 | 140 | 140 | 140 | 140 | 165 | 160 |
| Comparative Toner 121 | 160 | 160 | 160 | 160 | 175 | 170 |
| Compartive Toner 122 | 160 | 160 | 160 | 160 | 180 | 175 |
| Comparative Toner 123 | 170 | 170 | 170 | 170 | 185 | 180 |

TABLE 14

| (FilmFixing) Toner No. | F-1 | F-2 | F-3 | F-4 | F-C1 | F-C2 |
|---|---|---|---|---|---|---|
| Toner 121 | 140 | 140 | 140 | 140 | 160 | 155 |
| Toner 122 | 140 | 140 | 140 | 140 | 155 | 155 |
| Toner 123 | 145 | 145 | 145 | 145 | 165 | 160 |
| Toner 124 | 140 | 140 | 140 | 140 | 160 | 155 |
| Toner 125 | 145 | 145 | 145 | 145 | 160 | 160 |
| Toner 126 | 145 | 145 | 145 | 145 | 165 | 160 |
| Toner 127 | 140 | 140 | 140 | 140 | 160 | 155 |
| Toner 128 | 145 | 145 | 145 | 145 | 165 | 160 |
| Toner 129 | 145 | 145 | 145 | 145 | 165 | 160 |
| Toner 130 | 140 | 140 | 140 | 140 | 165 | 160 |
| Comparative Toner 121 | 160 | 160 | 160 | 160 | 175 | 170 |
| Comparative Toner 122 | 160 | 160 | 160 | 160 | 180 | 175 |
| Comparative Toner 123 | 170 | 170 | 170 | 170 | 185 | 180 |

As is apparent from Tables 13 and 14, the toner containing polyesters having an aromatic ring and low molecular polyolefins statically repulses the fixing rollers at a low temperature and humidity. As a result, adhesion of the toner to the rollers decreases and the adhesion to paper increases.

EXAMPLE 4

Preparation of low molecular weight polyolefin

Polypropylenes PP-1 through PP-10 were obtained in the same manner as in Example 1.

Preparation of toner

One hundred parts of a polyester resin (PEs), 5 parts of carbon black and the above polypropylene were mixed, and fusibly kneaded. The domain diameter of the polypropylene was adjusted by properly selecting the screw shape of the kneader, its rotating speed or kneading temperature. Thereafter, the resulting mixture was pulverized and classified to obtain color particles having a volume average particle diameter of 8.3 μm. Thus, color particles 201 through 210 were obtained.

One hundred parts of a styrene-acryl resin (St-AC), 5 parts of carbon black and one part of charge controlling agent consisting of a metal complex were mixed with the above polypropylene. Color particles 211 through 220 were obtained according to the above procedure. The domain diameter of the releasing agent in these color particles was measured according to the above described method.

Thereafter, hydrophobic silica was added to color particles 201 through 220 in an amount of 0.8% to obtain toners 201 through 220. Each of these toners was mixed with a ferrite carrier having a volume average particle diameter of 62 μm covered with a styrene-acryl resin to obtain developer having a toner content of 7 weight %.

The charging amount of the developer above obtained was measured at a low temperature and humidity according to a blow-off method. Toners 201 to 220 are collectively shown in Table 15.

TABLE 15

| Toner No. | Color Particle No. | Resin | PP used | PP Content (weight parts) | PP Domain Diameter (μm) | Charging Amount (μc/g) | Remarks |
|---|---|---|---|---|---|---|---|
| Toner 201 | Color Particle 1 | PEs | PP1 | 3 | 0.81 | −20.2 | Inv. |
| Toner 202 | Color Particle 2 | PEs | PP2 | 3.5 | 0.77 | −23.1 | Inv. |
| Toner 203 | Color Particle 3 | PEs | PP3 | 3 | 0.57 | −19.6 | Inv. |
| Toner 204 | Color Particle 4 | PEs | PP4 | 4 | 0.69 | <21.1 | Inv. |
| Toner 205 | Color Particle 5 | PEs | PP5 | 3 | 0.52 | −20.3 | Inv. |
| Toner 206 | Color Particle 6 | PEs | PP6 | 3 | 0.46 | −21.9 | Inv. |
| Toner 207 | Color Particle 7 | PEs | PP7 | 5 | 0.80 | −22.7 | Inv. |
| Toner 208 | Color Particle 8 | PEs | PP8 | 4 | 0.61 | −19.9 | Inv. |
| Toner 209 | Color Particle 9 | PEs | PP9 | 3 | 0.33 | −20.2 | Inv. |
| Toner 210 | Color Particle 10 | PEs | PP10 | 3 | 0.24 | −21.5 | Inv. |
| Toner 211 | Color Particle 11 | St—Ac | PP1 | 3 | 0.88 | −20.0 | Inv. |
| Toner 212 | Color Particle 12 | St—Ac | PP2 | 3.5 | 0.88 | −19.1 | Inv. |
| Toner 213 | Color Particle 13 | St—Ac | PP3 | 3 | 0.54 | −18.9 | Inv. |
| Toner 214 | Color Particle 14 | St—Ac | PP4 | 4 | 0.72 | −20.2 | Inv. |
| Toner 215 | Color Particle 15 | St—Ac | PP5 | 3 | 0.40 | −19.6 | Inv. |
| Toner 216 | Color Particle 16 | St—Ac | PP6 | 3 | 0.39 | −19.5 | Inv. |
| Toner 217 | Color Particle 17 | St—Ac | PP7 | 5 | 0.81 | −21.2 | Inv. |
| Toner 218 | Color Particle 18 | St—Ac | PP8 | 4 | 0.55 | −20.9 | Inv. |
| Toner 219 | Color Particle 19 | St—Ac | PP9 | 3 | 0.21 | −21.0 | Inv. |
| Toner 220 | Color Particle 20 | St—Ac | PP10 | 3 | 0.36 | −20.3 | Inv. |

Inv.: Invention
Comp.: Comparative

The same procedures as Example 2 were carried out using the above obtained developer and a fixing ratio was measured.

The developers were evaluated for off-set property according to the following method.

Evaluation of offset property

The offset property was evaluated at the temperature at which the fixing ratio was 70%. A 5×5 $cm^2$ lattice image having 0.2 mm wide lines arranged at intervals of 5 mm was transferred without being fixed onto a leading edge of paper, and using the resulting paper, offset property was evaluated. The fixing was carried out at the above temperature, and whether or not a portion of the lattice image was transferred to non-image portions of the paper and image defects were produced was observed. The evaluation criteria were as follows:

○: No offset occurrence

Δ: Slight stains occurred

X: Stains markedly occurred

The results are shown in Tables 16 and 17.

In the Tables the temperature giving 70% fixing ratio and the offset evaluation criteria are described together.

TABLE 16

| | Heat Roller Fixing Device | | | | | | |
|---|---|---|---|---|---|---|---|
| Toner No. | R-1 °C. | R-2 °C. | R-3 °C. | R-4 °C. | R-C1 °C. | R-C1 °C. | Remarks |
| Toner 201 | 150:○ | 150:○ | 150:○ | 150:○ | 165:Δ | 160:Δ | Invention |
| Toner 202 | 145:○ | 145:○ | 145:○ | 145:○ | 155:Δ | 150:Δ | Invention |
| Toner 203 | 150:○ | 150:○ | 150:○ | 150:○ | 160:Δ | 160:Δ | Invention |
| Toner 204 | 145:○ | 145:○ | 145:○ | 145:○ | 160:Δ | 155:Δ | Invention |
| Toner 205 | 155:○ | 155:○ | 155:○ | 155:○ | 165:Δ | 160:Δ | Invention |
| Toner 206 | 165:○ | 165:○ | 165:○ | 165:○ | 175:Δ | 175:Δ | Invention |
| Toner 207 | 150:○ | 150:○ | 150:○ | 150:○ | 165:Δ | 160:Δ | Invention |
| Toner 208 | 155:○ | 155:○ | 155:○ | 155:○ | 170:Δ | 165:Δ | Invention |
| Toner 209 | 150:○ | 150:○ | 150:○ | 150:○ | 170:Δ | 165:Δ | Invention |
| Toner 210 | 160:○ | 160:○ | 160:○ | 160:○ | 175:Δ | 170:Δ | Invention |
| Toner 211 | 140:○ | 140:○ | 140:○ | 140:○ | 160:Δ | 160:Δ | Invention |
| Toner 212 | 145:○ | 145:○ | 145:○ | 145:○ | 165:Δ | 160:Δ | Invention |
| Toner 213 | 145:○ | 145:○ | 145:○ | 145:○ | 165:Δ | 160:Δ | Invention |
| Toner 214 | 140:○ | 140:○ | 140:○ | 140:○ | 155:Δ | 150:Δ | Invention |
| Toner 215 | 150:○ | 150:○ | 150:○ | 150:○ | 170:Δ | 165:Δ | Invention |
| Toner 216 | 160:○ | 160:○ | 160:○ | 160:○ | 175:Δ | 170:Δ | Invention |
| Toner 217 | 155:○ | 155:○ | 155:○ | 155:○ | 170:Δ | 165:Δ | Invention |
| Toner 218 | 145:○ | 145:○ | 145:○ | 145:○ | 165:Δ | 160:Δ | Invention |
| Toner 219 | 150:○ | 150:○ | 150:○ | 150:○ | 170:Δ | 170:Δ | Invention |
| Toner 220 | 155:○ | 155:○ | 155:○ | 155:○ | 175:Δ | 170:Δ | Invention |

TABLE 17

| Toner No. | Heat Film material Fixing Device F-1 °C. | F-2 °C. | F-3 °C. | F-4 °C. | F-C1 °C. | F-C2 °C. | Remarks |
|---|---|---|---|---|---|---|---|
| Toner 201 | 145:○ | 145:○ | 145:○ | 145:○ | 160:Δ | 155:Δ | Invention |
| Toner 202 | 140:○ | 140:○ | 140:○ | 140:○ | 150:Δ | 150:Δ | Invention |
| Toner 203 | 145:○ | 145:○ | 145:○ | 145:○ | 155:Δ | 150:Δ | Invention |
| Toner 204 | 140:○ | 140:○ | 140:○ | 140:○ | 155:Δ | 150:Δ | Invention |
| Toner 205 | 150:○ | 150:○ | 150:○ | 150:○ | 155:Δ | 150:Δ | Invention |
| Toner 206 | 160:○ | 160:○ | 160:○ | 160:○ | 170:Δ | 165:Δ | Invention |
| Toner 207 | 145:○ | 145:○ | 145:○ | 145:○ | 160:Δ | 155:Δ | Invention |
| Toner 208 | 150:○ | 150:○ | 150:○ | 150:○ | 165:Δ | 160:Δ | Invention |
| Toner 209 | 145:○ | 145:○ | 145:○ | 145:○ | 165:Δ | 160:Δ | Invention |
| Toner 210 | 155:○ | 155:○ | 155:○ | 155:○ | 170:Δ | 165:Δ | Invention |
| Toner 211 | 135:○ | 135:○ | 135:○ | 135:○ | 160:Δ | 155:Δ | Invention |
| Toner 212 | 140:○ | 140:○ | 140:○ | 140:○ | 160:Δ | 155:Δ | Invention |
| Toner 213 | 140:○ | 140:○ | 140:○ | 140:○ | 160:Δ | 160:Δ | Invention |
| Toner 214 | 135:○ | 135:○ | 135:○ | 135:○ | 155:Δ | 150:Δ | Invention |
| Toner 215 | 140:○ | 140:○ | 140:○ | 140:○ | 165:Δ | 160:Δ | Invention |
| Toner 216 | 155:○ | 155:○ | 155:○ | 155:○ | 165:Δ | 165:Δ | Invention |
| Toner 217 | 150:○ | 150:○ | 150:○ | 150:○ | 165:Δ | 160:Δ | Invention |
| Toner 218 | 145:○ | 145:○ | 145:○ | 145:○ | 165:Δ | 160:Δ | Invention |
| Toner 219 | 145:○ | 145:○ | 145:○ | 145:○ | 160:Δ | 155:Δ | Invention |
| Toner 220 | 150:○ | 150:○ | 150:○ | 150:○ | 170:Δ | 165:Δ | Invention |

As is apparent from Tables 16 and 17, the heat fixing method employing the toner of the invention and the silicone oil of the invention prevents offset phenomenon and improves the fixing ratio in both heat roller and heat film material fixing method.

EXAMPLE 5

The above described fixing device was placed in the circumstances of high temperature and humidity (30° C./80% RH), and 30,000 sheets were copied continuously using the above developers. Then, the developing durability was evaluated.

Evaluation of durability

The reflection densities of the solid image at the first copy and the 30,000th copy were measured. Further, fog and toner scattering were observed. The results are shown in Table 18.

As is apparent from Table 18, the heat fixing method employing the toner of the invention and the silicone oil of the invention exhibits no difference between the reflection densities at the beginning and the end of copying, and produces no fog and toner scattering at a high temperature and humidity. The method of the invention can provide excellent image for a long term.

What is claimed is:

1. A fixing method comprising passing a recording material with a toner image between a heat fixing member and a pressure applying member contacting the heat fixing member to fix the toner onto the recording material, a silicone oil being coated on the surface of the heat fixing member, wherein the toner contains a binder resin and a low molecular weight polyolefin, and the silicone oil is a fluorine-

TABLE 18

| Toner No. | Reflection Image Density First Copy | 30,000th Copy | Fog | Toner Scattering | Remarks |
|---|---|---|---|---|---|
| Toner 201 | 1.40 | 1.37 | None | None | Invention |
| Toner 202 | 1.41 | 1.40 | None | None | Invention |
| Toner 203 | 1.42 | 1.41 | None | None | Invention |
| Toner 204 | 1.40 | 1.39 | None | None | Invention |
| Toner 205 | 1.40 | 1.38 | None | None | Invention |
| Toner 206 | 1.41 | 1.37 | None | None | Invention |
| Toner 207 | 1.40 | 1.40 | None | None | Invention |
| Toner 208 | 1.40 | 1.42 | None | None | Invention |
| Toner 209 | 1.39 | 1.39 | None | None | Invention |
| Toner 210 | 1.40 | 1.37 | None | None | Invention |
| Toner 211 | 1.42 | 1.40 | None | None | Invention |
| Toner 212 | 1.38 | 1.42 | None | None | Invention |
| Toner 213 | 1.40 | 1.39 | None | None | Invention |
| Toner 214 | 1.41 | 1.41 | None | None | Invention |
| Toner 215 | 1.40 | 1.39 | None | None | Invention |
| Toner 216 | 1.39 | 1.42 | None | None | Invention |
| Toner 217 | 1.38 | 1.39 | None | None | Invention |
| Toner 218 | 1.40 | 1.41 | None | None | Invention |
| Toner 219 | 1.42 | 1.40 | None | None | Invention |
| Toner 220 | 1.41 | 1.39 | None | None | Invention |

containing silicone oil having a viscosity of 20 to 1,000 centipoise at 25° C. and having a structural unit represented by the following Formula:

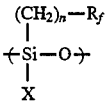

wherein X represents a saturated hydrocarbon group having 1 to 4 carbon atoms or an aryl group; $R_f$ represents $Z—(CF_2)_m—$ in which Z represents a hydrogen atom or a fluorine atom and m represents an integer of 2 to 10; and n represents an integer of 1 to 4.

2. The fixing method of claim 1, wherein the polyolefin has a number average molecular weight of 800 to 10,000, and a weight average molecular weight of 3,000 to 50,000.

3. The fixing method of claim 2, wherein the polyolefin has a number average molecular weight of 1,000 to 9,000, and a weight average molecular weight of 4,000 to 40,000.

4. The fixing method of claim 2, wherein the polyolefin is selected from the group consisting of polyethylene, polypropylene, polybutylene and copolymers thereof.

5. The fixing method of claim 4, wherein the polyolefin is selected from the group consisting of polyethylene, polypropylene and an ethylene-propylene copolymer.

6. The fixing method of claim 5 wherein the polyolefin is polypropylene.

7. The fixing method of claim 1, wherein the domain diameter of the polyolefin in the toner is 0.1 to 1.0 μm.

8. The fixing method of claim 1, wherein the toner contains the polyolefin in an amount of 1 to 5% by weight.

9. The fixing method of claim 1, wherein the binder resin is a styrene resin.

10. The fixing method of claim 1, wherein m represents an integer 2 to 8.

11. The fixing method of claim 1, wherein the fluorine-containing silicone oil contains in its molecular structure the unit represented by said Formula in an amount of 20 mol % or more.

12. The fixing method of claim 1, wherein the heat fixing member is a heat roller.

13. The fixing method of claim 1, wherein the heat fixing member is a film material.

14. The fixing method of claim 1, wherein the fixing line speed is 40 to 400 mm/second.

15. The fixing method of claim 1, wherein the silicone oil is coated on the surface of the heat fixing member at a speed of $1.4\times10^{-6}$ cc/cm$^3$ or less.

16. The fixing method of claim 1, wherein the polyolefin is polypropylene having a number average molecular weight of 1,000 to 9,000 and a weight average molecular weight of 4,000 to 40,000, the domain diameter of the polypropylene is 0.1 to 1.0 μm, and said $R_f$ represents $Z—(CF_2)_m—$ in which z represents a hydrogen atom or a fluorine atom, and m represents an integer 2 to 10.

* * * * *